US006006678A

United States Patent [19]

Merit et al.

[11] Patent Number: 6,006,678

[45] **Date of Patent: *Dec. 28, 1999**

[54] METHOD AND APPARATUS FOR SELECTIVE ENGAGEMENT OF SHELF SEPARATION STRUCTURES CONFORMED TO PROVIDE VISUAL DISPLAY SURFACES

[76] Inventors: William Merit; Jo Merit, both of 575 Esplanade #106, Redondo Beach, Calif. 90277

[ * ] Notice: This patent is subject to a terminal disclaimer.

[21] Appl. No.: 08/962,616

[22] Filed: Nov. 3, 1997

Related U.S. Application Data

[63] Continuation-in-part of application No. 08/556,519, Nov. 13, 1995, Pat. No. 5,690,038.

[51] Int. Cl.[6] ..... A47F 5/00

[52] U.S. Cl. ..... 108/60; 108/61; 211/184

[58] Field of Search ..... 108/60, 61, 27, 108/31; 312/234.4, 234.5, 140.4; 211/184; 248/71, 74.2; 403/395, 397

[56] References Cited

U.S. PATENT DOCUMENTS

| | | | |
|---|---|---|---|
| 1,981,973 | 11/1934 | Tinnerman | 403/397 X |
| 2,061,463 | 11/1936 | Hall | 248/74.2 X |
| 2,626,845 | 1/1953 | Dubach | 108/27 X |
| 3,154,281 | 10/1964 | Frank | 248/74.2 X |
| 3,285,429 | 11/1966 | Propst | 211/184 |
| 3,698,568 | 10/1972 | Armstrong | 211/184 |
| 4,615,276 | 10/1986 | Garabedian | 108/61 |
| 4,775,058 | 10/1988 | Yatsko | 211/184 |
| 5,148,927 | 9/1992 | Gebka | 108/60 X |
| 5,341,945 | 8/1994 | Gibson | 211/184 |
| 5,690,038 | 11/1997 | Merit et al. | 108/60 |
| 5,738,019 | 4/1998 | Parker | 108/61 X |

FOREIGN PATENT DOCUMENTS

| | | | |
|---|---|---|---|
| 625763 | 8/1927 | France | 211/184 |
| 694795 | 9/1965 | Italy | 312/234.4 |
| 465172 | 12/1968 | Switzerland | 312/140.4 |
| 1338325 | 11/1973 | United Kingdom | 248/74.2 |

OTHER PUBLICATIONS

The Ultimizer by Intercraft instruction pamphlet. (Exact Date of Pamphlet Unknown; Sold and/or In Public Use Prior to 1990).

*Primary Examiner*—Peter M. Cuomo
*Assistant Examiner*—Janet M. Wilkens

[57] ABSTRACT

Apparatus and method for selectively securing a shelf separator array to display shelves includes a plurality of openings formed in the shelves, and resilent clips that are securable both to the separator structure and in the openings. In the first form the clips are provided with resilient split retaining clamps engageable to the extrusion forming the separator structure and resilient opposing projections conformed for receipt in a selected opening. In another form, the extrusion forming the separator structure includes a groove formed longitudinally therein in which fitted portions of the clips are slidably received. The projections depending from the fitted portions are then useful for insertion in a selected opening in the shelf. The extrusion may then be provided with recessed display panels extending over the shelf edge in which various message cards may be displayed.

4 Claims, 3 Drawing Sheets

METHOD AND APPARATUS FOR SELECTIVE ENGAGEMENT OF SHELF SEPARATION STRUCTURES CONFORMED TO PROVIDE VISUAL DISPLAY SURFACES

REFERENCE TO RELATED APPLICATIONS

This application is a continuation-in-part of our prior U.S. patent application Ser. No. 08/556,519, filed on Nov. 13, 1995 and now issued as U.S. Pat. No. 5,690,038. Priority is claimed to the original filing date of the parent application for all mater common therewith.

BACKGROUND OF THE INVENTION

1. Field of the Invention

The present invention relates to retail display structures, and more particularly to shelf separator structures and the manner of securing same to merchandise shelves.

2. Description of the Prior Art

In merchandizing and consumer commerce the presentation of goods to the purchaser is a matter of some significance, the neatness and organization of the display having a strong psychological association with quality. Moreover, a neat, well organized, arrangement of goods advances purchasing convenience, particularly when the shelf arrangement is clearly marked. Thus the art of presenting goods for purchase has had some attention in the past, and various display structures have been devised that attend to these concerns.

In any mechandizing scheme the fundamental mechanisms of successful commerce require a constant modification of the goods offered for sale. The style, selection, and assortment of goods is therefore constantly changing. These interests of the seller of a constantly changing assortment are thus a fact of business and the display mechanisms therefor are therefore continuously changing. For these reasons the prior art is replete with various shelf organising structures that include the facility for convenient change. Examples of such adjustable display organizers may be found in U.S. Pat. No. 5,341,945 to Gibson; U.S. Pat. No. 4,775,058 to Yatsko; and U.S. Pat. No. 4,615,276 to Garabedian. Each of the foregoing describes shelf divider assemblies in which a front rail is attached to the shelf edge, either by adhesive or by clamping, to provide a fixing point or mount for orthogonal shelf dividers in adjustable spacing. While suitable for the purposes intended, this substantially permanent attachment of the rail to the shelf edge limits the options of use and further limits any cleaning or refinishing of the shelf itself.

More importantly, fixed edge rails on the shelf edge limit the facility of moving fresh goods onto the shelf surface. The rail may also be utilized to form display panels on which pricing or other descriptive information is set out and which therefore present a ledge in the path of loading. Edge rail structures that are conveniently removed are therefore desired and sought and it is one such structure that is disclosed herein.

SUMMARY OF THE INVENTION

Accordingly, it is the general purpose and object of the present invention to provide a securing mechanism for a shelf rail conformed for convenient release and reattachment.

Other objects of the invention are to provide a releasable securing mechanism for shelf edge railing which incorporates in its structure the engagement aspects of shelf separators.

Further objects of the invention are to provide a rail securing clip that is simple in use and convenient in fabrication.

Yet further objects of the invention are to provide a visual display edge surface that is conveniently removed from the shelf.

Briefly, these and other objects are accomplished within the present invention by way of a clip structure useful in capturing and retaining a shelf rail and characterised by a flat base element from which a resilient insert extends. On the opposite surface of the base element the first embodiment of the clip structure includes a cantelevered and offset retaining clamp conformed to mate with the shelf rail. One of a plurality of openings in the shelf is then selected to receive in compressive fit the insert, thus fixing the clip and the captured rail to the shelf.

In a second implementation the rail is provided with a slotted groove shaped to receive in sliding receipt the base member of a second form of the clip, the resilient insert extending from the groove for insertion in a selected opening in the shelf. In this structural arrangement the opposite surface of the base element is left smooth, conforming in section with the groove.

In each form, the foregoing attachment structure provides a convenient manner for selective attachment of the rail to the shelf which is easily released by the simple extraction of the resilient fitting from the selected opening. The rail may then serve as a display surface and also as an attachment structure or mount for separators.

Thus removal and reattachment are events wholly rendered convenient, allowing for shelf cleaning or restocking of the goods on the shelf. At the same time pricing information and other matter may be positioned on the edge panels of each rail, coordinating the cleaning and restocking task with the display of information like pricing or quantity. Following such restocking or cleaning the engaged rail then provides the necessary structure for attaching orthogonal separators that then organize the goods on the shelf.

DESCRIPTION OF THE PREFERRED EMBODIMENTS

Figure 1:
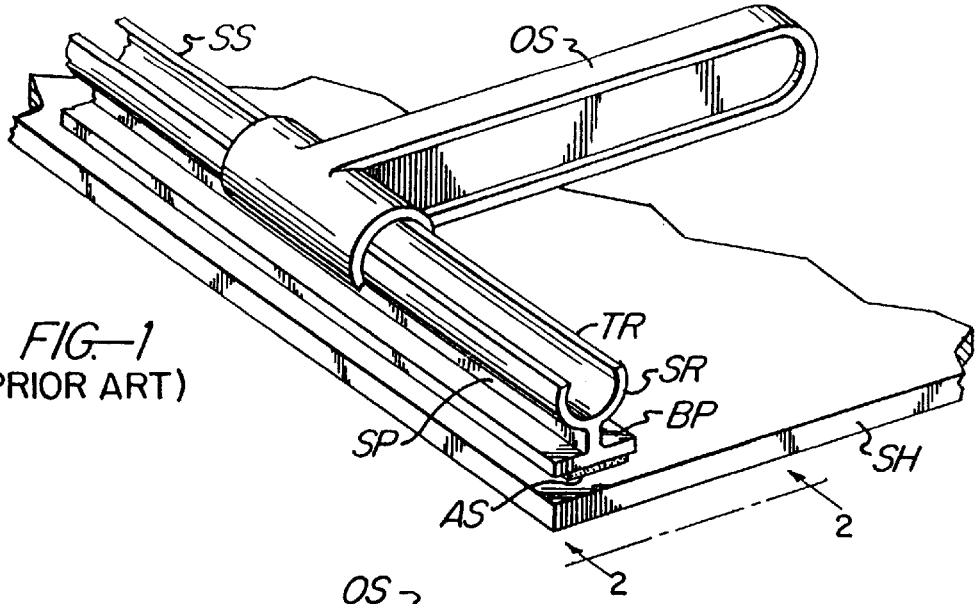
FIG.—1 (PRIOR ART)
FIG. 1 is a perspective illustration of a prior art shelf separator structure, illustrating one conventional manner of attachment thereof.
Figure 2:
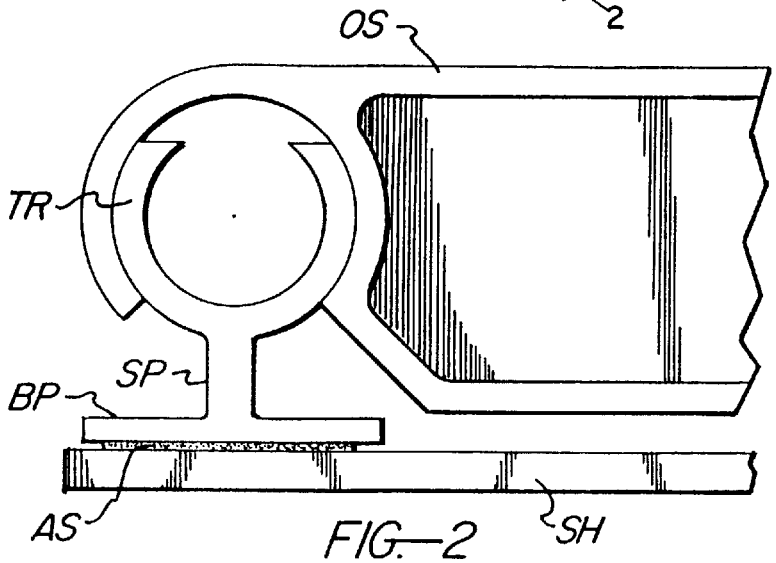
FIG.—2 (PRIOR ART)
FIG. 2 is a sectional view of the prior art structure shown in FIG. 1.

As shown in FIGS. 1 and 2, one conventional form of a shelf separator structure, generally referred to as SS, includes a shelf rail extrusion SR defined by a base plate BP and an elongate split tube rail TR formed on the edge of a vertical spine SP extending longitudinally on the base plate. In practice, one longitudinal edge of base plate BP may extend at an angle to form an edge display panel on which informative messages may be inscribed. This rail extrusion SR is then attached on the edge surface of a shelf SH, either by adhesive stripping AS or by clamping (not shown) and thus forms an attachment structure for a number of orthogonal separators OS. Examples of this prior art structure may be found in the teachings of U.S. Pat. No. 5,341,945 to Gibson, and in articles sold commercially by the Display Products Division of Jet Plastics, Inc., 941 North Eastern Ave., Los Angeles, Calif. 90063, under model designations 1900 and 2901.

While many alternative implementations of the foregoing prior art separator structures may be found, all have in common the more or less permanent manner of attachment of the rail to the shelf edge. This common aspect, and the necessity of a raised bead (or recess) for engagement with the separator ends, fixes an edge projection above the shelf surface, preventing convenient cleaning and restocking of the shelf.

Figure 3:
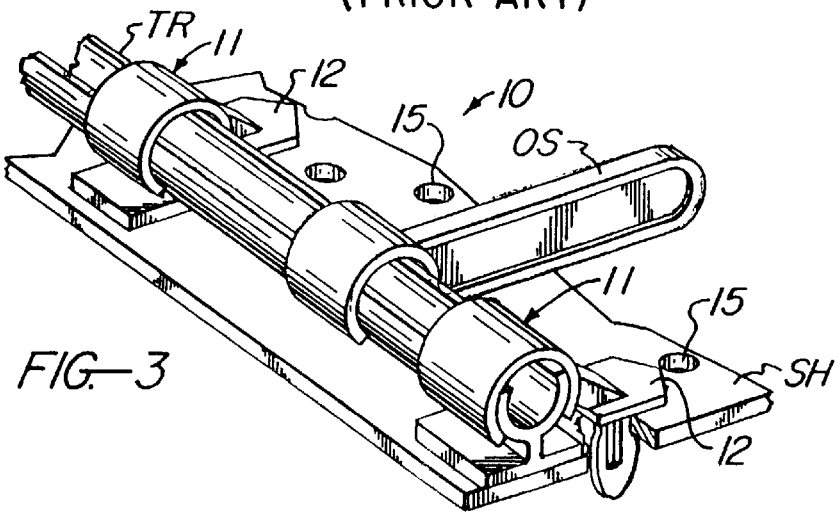
FIG. 3 is a perspective illustration of a shelf separator structure illustrating a first manner of attachment thereof in accordance with the present invention.
Figure 4:
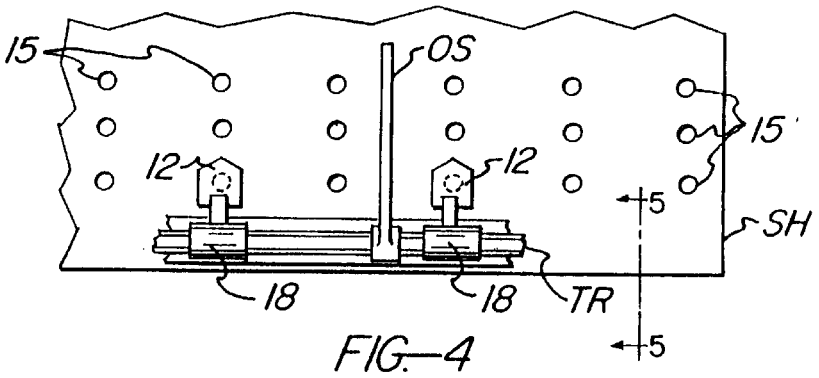
FIG. 4 is a top view of a shelf modified for attachment of a shelf rail in accordance with the first inventive example illustrated in FIG. 3.
Figure 5:
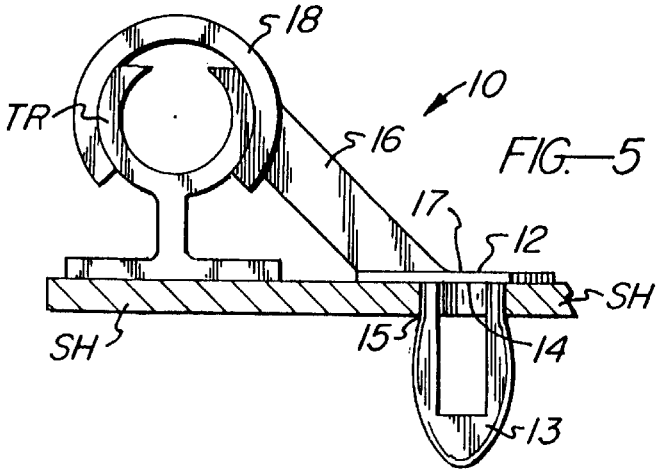
FIG. 5 is a sectional view taken along line 5—5 of FIG. 4.

As shown in FIGS. 3–5, inclusive, a first example of a releasable attachment structure according to the invention herein, generally referred to by the numeral 10, is effected by a retaining clip 11 that engages both the split tube rail or mount TR and one of several perforations 15 in the shelf SH. In more detail, clip 11 is defined by a generally rectangular, thin, base plate 12 having a resilient insert 13 projecting orthogonally from the bottom surface 14 thereof, and a vertical web 16 projecting away from the edge of the upper surface 17. Web 16 then attaches to a split tubular segment 18 conformed for fitted engagement on the split tube rail TR.

Thus by fitted engagement of the resilient insert 13 in opening 15, and segment 18 on the split tube rail TR, a bridging connection is formed fixing the extrusion SR to the shelf. Insert 13, extending through the shelf thickness, is then exposed on the lower shelf side and can thus be ejected by any convenient mode of pressure thereto. As a consequence, the engagement of the rail assembly to the shelf is removable at will, allowing for shelf cleaning and stocking.

This attachment technique allows further selection by way of plural arrays of openings 15, as illustrated in FIG. 4. The rail extrusion, therefore, can take several forms and the deployment thereof on the shelf surface may be equally varied. Once thus fixed, the separators OS can then be distributed along the shelf in accordance with the grouping of the stock assortment.

Figure 6:
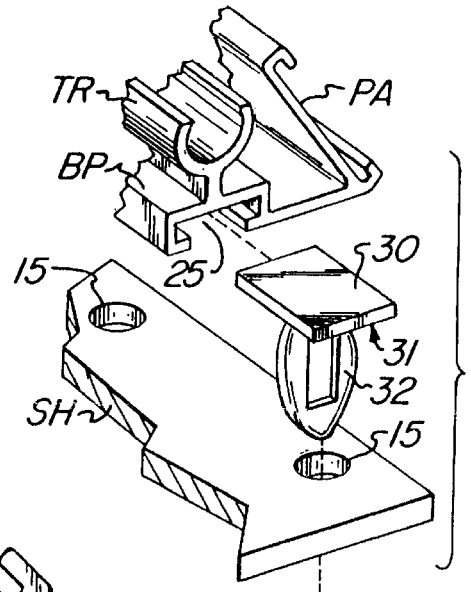
FIG. 6 is yet another perspective view, separated by parts, of a second example of the inventively attached shelf separator structure.
Figure 7:
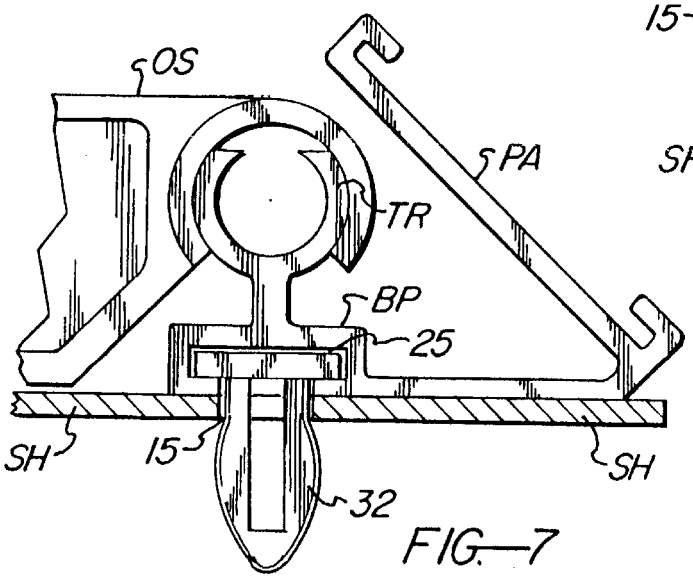
FIG. 7 is a sectional view of the inventive structure shown in FIG. 6.

By way of the second example, illustrated in FIGS. 6 and 7, a modified rail structure of the type earlier described includes a longitudinal slotted recess 25 in the base plate BP and a display panel PA. Like numbered parts illustrating like functions, rail structure SS includes once again a split tube rail or mount TR onto which separators OS may be mounted. An alternative retaining clip, generally designated by the numeral 30, includes a rectangular plate 31 conformed in section for receipt in recess 25. A resilient fitting 32 descending from plate 31 then emerges through the recess slot to engage once again in opening 15.

Thus two forms of removable attachment may be used interchangeably, in each instance rendered convenient in placement selection by the opening arrays. In this manner a simple, flexibly selective, shelf separating function may be effected in parts easily cast or molded from known polymeric materials.

Figure 8:
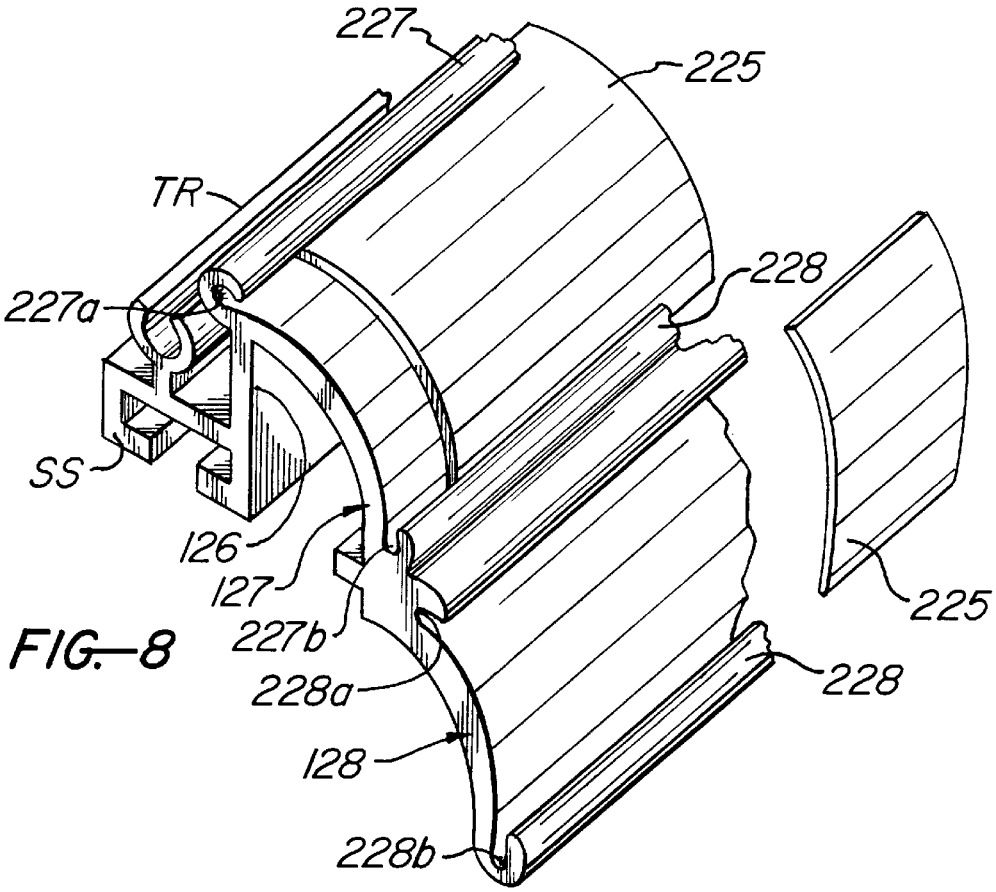
FIG. 8 is a perspective illustration, separated by parts, of yet a further alternative of a shelf rail provided with a display panel.
Figure 9:
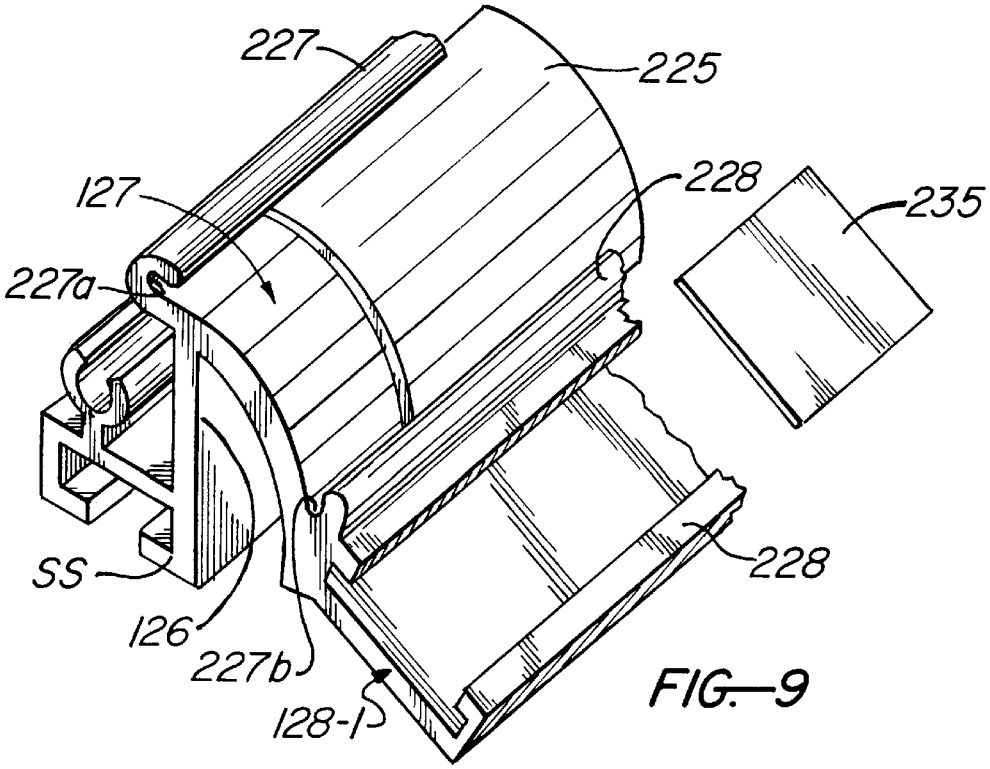
FIG. 9 is a further perspective illustration of yet another alternative embodiment of an inventive shelf rail provided with display panels.

As shown further in FIGS. 8 and 9, like numbered parts functioning in a like manner to that previously described, the rail structure SS, the split tube rail TR on which the separators OS are clipped may be povided with a vertical edge wall 126 supporting a set of arcuate display panels 127 and 128 along the length of the rail structure SS. Each panel 127 and 128 is provided with opposed longitudinal recesses shown as recesses 227*a* and 227*b* formed in edge beads 227 on panel 127 and recesses 228*a* and 228*b* formed in edge beads 228 on panel 128. A plurality of flexible display cards 225 and 235 are then selectively captured between the recesses, presenting to the shopper the information relating to the goods stored on the shelf between the separators OS.

While the display panels 127 and 128, illustrated in FIG. 8, are each of an arcuate section, such is for purposes of explanation only. Flat panel structures, like that shown in FIG. 9 as panel 128-1, are equally useful, particularly where large message areas are desired. Like numbered parts again functioning in a like manner, the foregoing structure may then retain larger message cards 235 between recesses 228*a* and 228*b* along the edges of panel 128-1.

In this manner the periodic cleaning and restocking task, during which the clips 31 are extracted from openings 15, may also include the sequence of re-labeling the goods displayed by exchanging the message cards 225 in the display panels 127 and 128. In consequence, a well organized restocking sequence is facilitated, improving the organizational aspects of the business.

Thus several forms of removable attachment may be used interchangeably, in each instance rendered convenient in placement selection by the opening arrays. In this manner a simple, flexibly selective, shelf separating function may be effected in parts easily cast or molded from known polymeric materials.

Obviously, many modification and variations may be effected without departing from the spirit of the instant invention. It is therefore intended that the scope of the invention be determined solely by the claims appended hereto.

We claim:

1. In a shelf separating assembly characterized by a shelf, an extrusion including an elongate base plate securable to said shelf, said base plate being defined by a front and rear edge and a first and second surface extending between said front and rear edge, an elongate split tubular rail fixed along said first surface of said base plate in spaced relationship therewith, and a plurality of separator members each provided with a fitting at one end thereof conformed for selective resilient engagement on said tubular rail to align said separator members on said shelf generally orthogonal relative said extrusion, the improvement comprising:

a slotted groove formed longitudinally in said base plate through said second surface in a direction opposite to said tubular rail;

attachment means conformed for selective engagement between said extrusion and said shelf, including a generally planar base piece defined by an upper and a lower surface and dimensioned in section for sliding receipt in said groove, and a resilient insert extending generally orthogonal from said lower surface to project through the slot of said groove;

a plurality of openings formed in said shelf each dimensioned in section for selected conforming receipt of said resilient insert; and a display structure depending from said front edge of said base plate and conformed to provide an inclined display panel including opposed recesses for capturing message cards therebetween.

2. Apparatus according to claim 1, wherein:

said display panel is generally arcuate between said opposed recesses.

3. Apparatus according to claim 1, wherein:

each said opening extends through the thickness of said shelf.

4. Apparatus according to claim 1, wherein:

said resilient insert exposed beyond said groove extends to a dimension greater than the thickness of said shelf.

* * * * *